US010518310B2

(12) United States Patent
Tang et al.

(10) Patent No.: US 10,518,310 B2
(45) Date of Patent: Dec. 31, 2019

(54) BENDING MOLD DEVICE FOR BIDIRECTIONAL PIPE BENDING

(71) Applicant: Jiangsu University Of Science And Technology Industrial Technology Research Institute Of Zhangjiagang, Jiangsu (CN)

(72) Inventors: Wenxian Tang, Jiangsu (CN); Jian Zhang, Jiangsu (CN); Hui Zhu, Jiangsu (CN); Hongcai Lin, Jiangsu (CN); Qinfeng Li, Jiangsu (CN); Yang Zhang, Jiangsu (CN); Shijie Su, Jiangsu (CN)

(73) Assignee: Jiangsu University of Science and Technology Industrial Technology Research Institute of Zhangjiagang, Jiangsu (CN)

( * ) Notice: Subject to any disclaimer, the term of this patent is extended or adjusted under 35 U.S.C. 154(b) by 288 days.

(21) Appl. No.: 15/532,816

(22) PCT Filed: Feb. 22, 2016

(86) PCT No.: PCT/CN2016/074205
§ 371 (c)(1),
(2) Date: Jun. 2, 2017

(87) PCT Pub. No.: WO2016/197623
PCT Pub. Date: Dec. 15, 2016

(65) Prior Publication Data

US 2018/0085808 A1 Mar. 29, 2018

(30) Foreign Application Priority Data

Jun. 11, 2015 (CN) ..... 2015 1 0316652

(51) Int. Cl.
*B21D 7/04* (2006.01)
*B21D 7/00* (2006.01)

(52) U.S. Cl.
CPC . *B21D 7/04* (2013.01); *B21D 7/00* (2013.01)

(58) Field of Classification Search
CPC ... B21D 7/00; B21D 7/02; B21D 7/04; B21D 7/024; B21D 37/02; B21D 37/04; B21D 37/06; B21D 37/12
(Continued)

(56) References Cited

U.S. PATENT DOCUMENTS 2,814,327 A * 11/1957 Charlton ..... B21D 11/07 72/156
3,200,631 A * 8/1965 Kritzer, Jr. ..... B21C 37/283 72/306
(Continued)

FOREIGN PATENT DOCUMENTS

CN 101817038 A 9/2010
CN 101934314 A 1/2011
(Continued)

OTHER PUBLICATIONS

Lin, Hongcai, CN-101934314-A, Machine Translation of Patent (Year: 2011).*

*Primary Examiner* — Shelley M Self
*Assistant Examiner* — Sarkis A Aktavoukian
(74) *Attorney, Agent, or Firm* — Muncy, Geissler, Olds & Lowe, P.C.

(57) ABSTRACT

A bending mold device for bidirectional pipe bending includes a mounting base which is horizontally arranged on a rack in a sliding manner. The mounting base includes a translation lead screw driving the mounting base to slide. The rack includes a lead screw nut. A pipe bending spindle is rotatably disposed on the mounting base and a power
(Continued)

mechanism is disposed on the mounting base. The upper end of the pipe bending spindle is movably connected to a lower rotating base. The lower rotating base includes a first pipe bending shaft and a second pipe bending shaft, which respectively include a first bending mold lower mold and a second bending mold lower mold. The rack includes a cylinder above the lower rotating base. The end part of a piston rod of the cylinder fixedly includes an upper limiting plate and a lower limiting plate in a sleeving manner.

12 Claims, 5 Drawing Sheets

(58) Field of Classification Search
USPC ..... 72/149
See application file for complete search history.

(56) References Cited

U.S. PATENT DOCUMENTS 3,475,938 A * 11/1969 Whitman ..... B21D 7/024 72/157
3,657,911 A * 4/1972 Clarke ..... B21D 11/06 72/157
3,680,347 A * 8/1972 Schenck ..... B21D 7/024 72/217
3,742,749 A * 7/1973 Bondarenko ..... B21D 7/02 72/217
4,048,834 A * 9/1977 Durbin ..... B21C 37/26 29/890.046
5,142,895 A 9/1992 Schuchert
5,373,719 A * 12/1994 Foerster ..... B21D 11/07 72/157
6,134,932 A * 10/2000 Marque ..... B21D 7/024 72/149
8,631,674 B2 * 1/2014 Christofilis ..... B21D 7/12 72/306
9,468,963 B2 * 10/2016 Fries ..... B21F 1/00
2005/0076694 A1 * 4/2005 Latour ..... B21D 7/022 72/307
2015/0040634 A1 * 2/2015 Costet ..... B21D 11/12 72/159

FOREIGN PATENT DOCUMENTS

CN 202461294 U 10/2012
CN 203109000 U 8/2013
CN 203448518 U 2/2014
CN 203541293 U 4/2014
CN 104226803 A 12/2014
CN 10488912 A 9/2015
CN 204770038 U 11/2015
JP S5942128 A 3/1984
JP S6160218 A 3/1986
KR 101066921 B1 9/2011
KR 20150032092 A * 3/2015
WO WO-2016199511 A1 * 12/2016 ..... B21D 7/024

* cited by examiner

BENDING MOLD DEVICE FOR BIDIRECTIONAL PIPE BENDING

BACKGROUND

Technical Field

The present invention relates to a bending mold device of bidirectional pipe bending.

Related Art

The existing bending mold device for bidirectional pipe bending is as mentioned in the invention patent with the patent number ZL201010230393.7, pipe bending is performed by adopting two whole bending dies, once a bending angle exceeds 180 degrees, the tube stock is clamped by the lower edge of the bending mold, and thus cannot be taken out of the bending mold.

SUMMARY

The present invention aims to provide a bending mold device for bidirectional pipe bending. The bending mold device can realize bidirectional pipe bending and can bend an elbow pipe for more than exceeding 180 degrees.

In order to solve the above technical problem, the technical solution adopted by the present invention is: a bending mold device for bidirectional pipe bending comprises a mounting base which is horizontally arranged on a rack in a sliding manner, the mounting base is provided with a translation lead screw driving the mounting base to slide and a translation motor driving the translation lead screw to rotate, the rack is fixedly provided with a lead screw nut matched with the translation lead screw, a pipe bending spindle is rotatably disposed on the mounting base, and a power mechanism driving the pipe bending spindle to rotate is disposed on the mounting base, the upper end of the pipe bending spindle is movably connected to a lower rotating base, the lower surface of the lower rotating base is provided with a long clamping slot parallel with the translation lead screw in the initial position, the pipe bending spindle is provided with a square clamping block matched with the long clamping slot, the upper part of the lower rotating base is vertically provided with a first pipe bending shaft and a second pipe bending shaft, the first pipe bending shaft and the second pipe bending shaft are alternatively concentric with the pipe bending spindle through the sliding of the mounting base, the first pipe bending shaft is rotatably provided with a first bending mold lower mold, the second pipe bending shaft is rotatably provided with a second bending mold lower mold, the rack is vertically downward provided with a cylinder above the lower rotating base, the end part of a piston rod of the cylinder is fixedly provided with an upper limiting plate and a lower limiting plate in a sleeving manner, the lower limiting plate is round plate not interfering with the rotation of an upper rotating base, the upper rotating base is movably clamped between the upper limiting plate and the lower limiting plate, the upper rotating base comprises a round left guiding part taking the distance from the first pipe bending shaft to the piston rod of the cylinder as a radius, a round right guiding part taking the distance from the second pipe bending shaft to the piston rod of the cylinder as a radius and a connecting part connected to a part of one side of the left guiding part away from the rack and a part of one side of the right guiding part away from the rack, the piston rod is located in a position, close to the connecting part, between the left guiding part and the right guiding part before the upper rotating base is subjected to pipe bending machining when the upper rotating base is in the initial position, the upper rotating base is rotatably provided with a first bending mold upper mold and a second bending mold upper mold, the middle part of the first bending mold upper mold is provided with a locating hole matched with the upper part of the first pipe bending shaft, and the middle part of the second bending mold upper mold is provided with a locating hole matched with the upper part of the second pipe bending shaft.

As a preferable solution, the lower surface of the upper rotating base is provided with two mounting columns used for mounting the first bending mold upper mold and the second bending mold upper mold respectively, bending mold covers rotatably sleeve the mounting columns, the mounting columns are provided with lower check rings for positioning the bending mold covers, and the lower parts of the two bending mold covers are connected to the first bending mold upper mold and the second bending mold lower mold respectively.

As a preferable solution, the mounting columns are provided with locating steps for locating the upper surfaces of the bending mold covers, and the mounting columns are provided with copper liner plates between the locating steps and the bending mold covers.

As a preferable solution, the holes in the lower parts of the locating holes of the first bending mold upper mold and the second bending mold upper mold are provided with bevels.

As a preferable solution, the lower rotating base comprises a rotating base body and an end cover, and the long clamping slot is arranged in the rotating base body.

As a preferable solution, the mounting base is a hollow mounting base, one side of the mounting base close to the rack is provided with an avoiding hole, the lead screw nut on the rack penetrates into the mounting base from the avoiding hole, the translation lead screw is rotatably arranged in the mounting base, one end of the translation lead screw penetrates out of the mounting base, and the translation motor is arranged outside the mounting base and is connected to one end of the translation lead screw penetrating out of the mounting base.

As a preferable solution, the power mechanism comprises a servomotor and a speed reducer which are connected by a coupler and an outputting shaft of the speed reducer is connected to the pipe bending spindle.

The present invention has the beneficial effects: since the upper mold of the bending mold is driven by the cylinder and can be completely separated from the lower mold, a tube stock subjected to be pipe bending can be separated from the bending mold, such that the tube stock can be bent for more than 180 degrees, and the upper rotating base comprises the round left guiding part taking the distance from the first pipe bending shaft to the piston rod of the cylinder as a radius, the round right guiding part taking the distance from the second pipe bending shaft to the piston rod of the cylinder as a radius and a connecting part connected to a part of one side of the left guiding part away from the rack and a part of one side of the right guiding part away from the rack, such that the upper rotating base can rotate without interfering with the piston rod of the cylinder, such that the device realize the relative rotating of the two bending dies while realizing the complete separation between the upper mold and lower mold of the bending mold, that is, the device can realize bidirectional pipe bending and can bend an elbow pipe more than for more than 180 degrees.

BRIEF DESCRIPTION OF THE DRAWINGS

In FIGS. 1-6: 1 Rack, 2 Mounting base, 3 Translation lead screw, 4 Translation motor, 5 Lead screw nut, 6 Pipe bending spindle, 61 Clamping block, 7 Power mechanism, 71 Coupler, 72 Servomotor, 73 Speed reducer, 8 Lower rotating base, 9 First pipe bending shaft, 10 Second pipe bending shaft, 11 First bending mold lower mold, 12 Second bending mold lower mold, 13 Cylinder, 14 Upper limiting plate, 15 Upper rotating base, 151 Left guiding part, 152 Right guiding plate, 153 Connecting part, 154 Mounting column, 16 Lower limiting plate, 17 First bending mold upper mold, 18 Second bending mold upper mold, 19 Bending mold cover, 20 Lower check ring, 21 Copper liner plate, 22 Tube stock.

DETAILED DESCRIPTION

Figure 1:
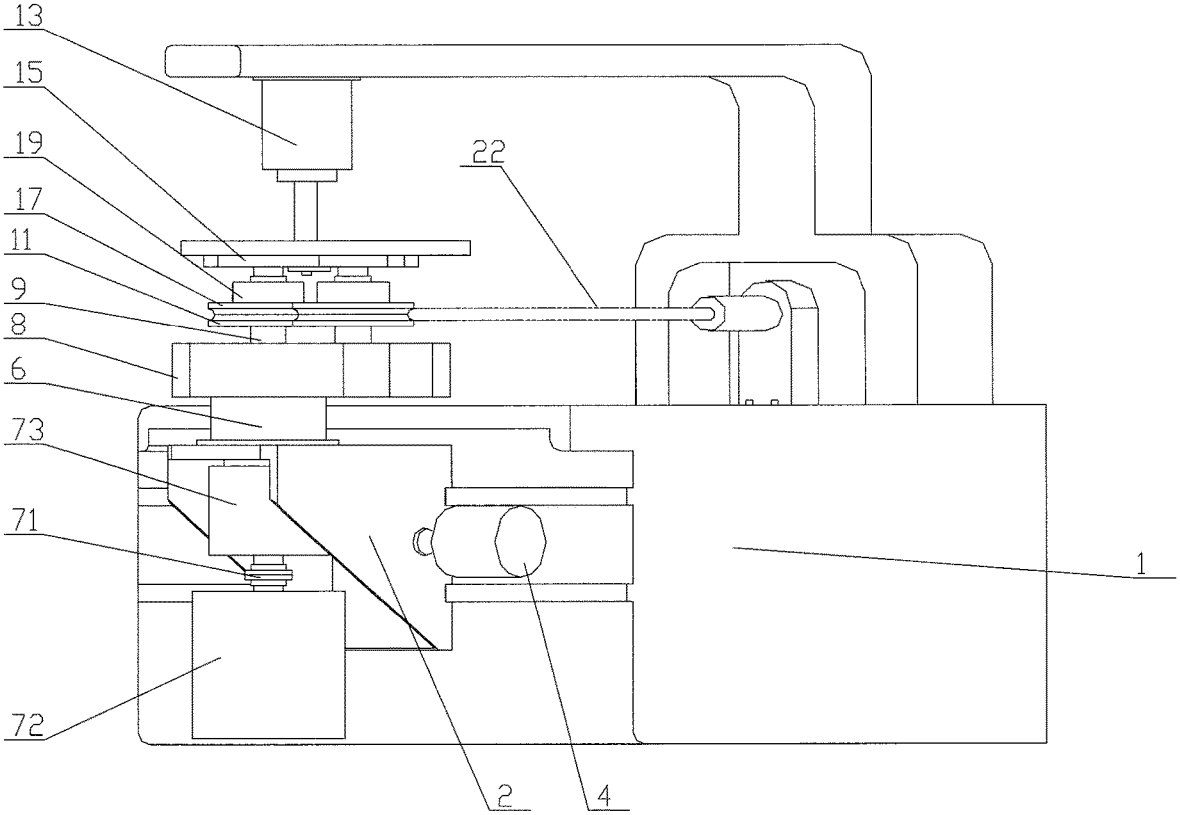
FIG. 1 is a schematic diagram of a stereoscopic structure of the present device and a rack together.
Figure 2:
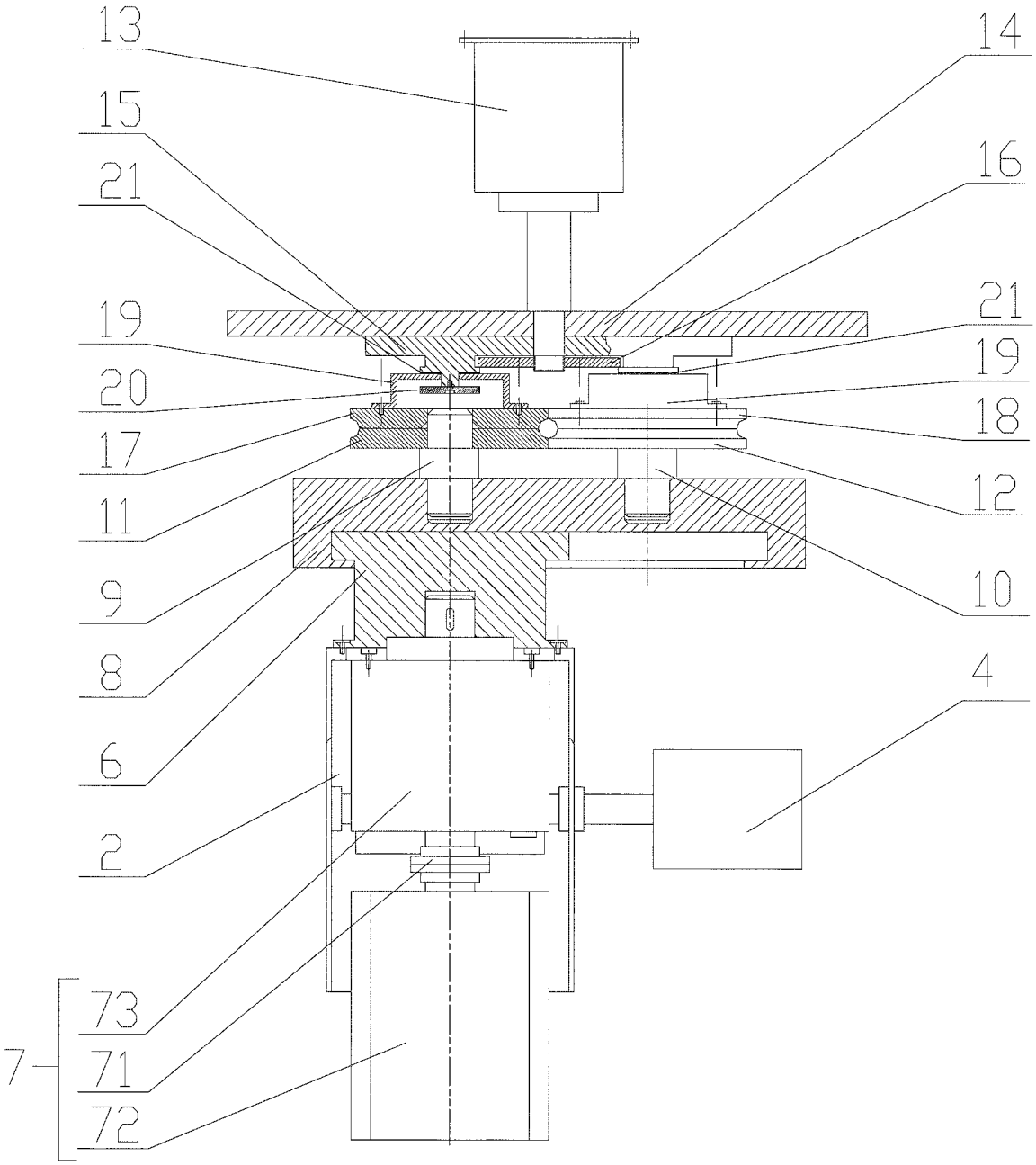
FIG. 2 is a schematic diagram of a main sectional view structure of the present device.
Figure 3:
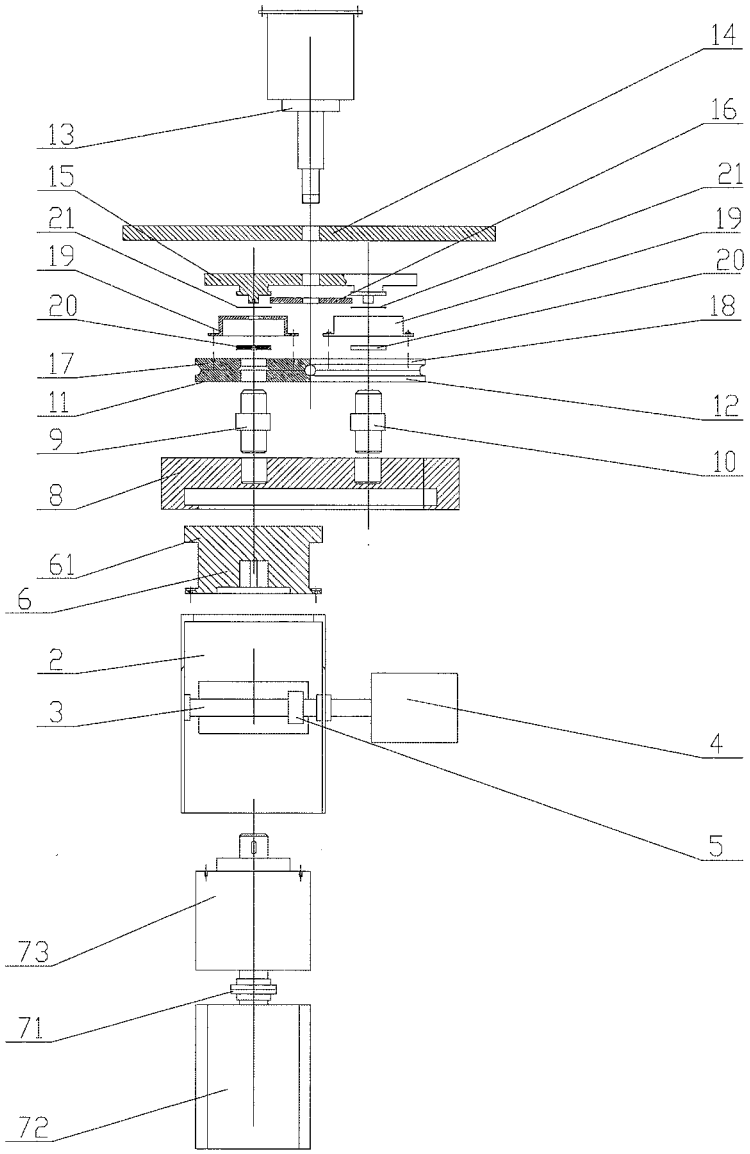
FIG. 3 is a schematic diagram of a main exploded view structure of the present device.
Figure 4:
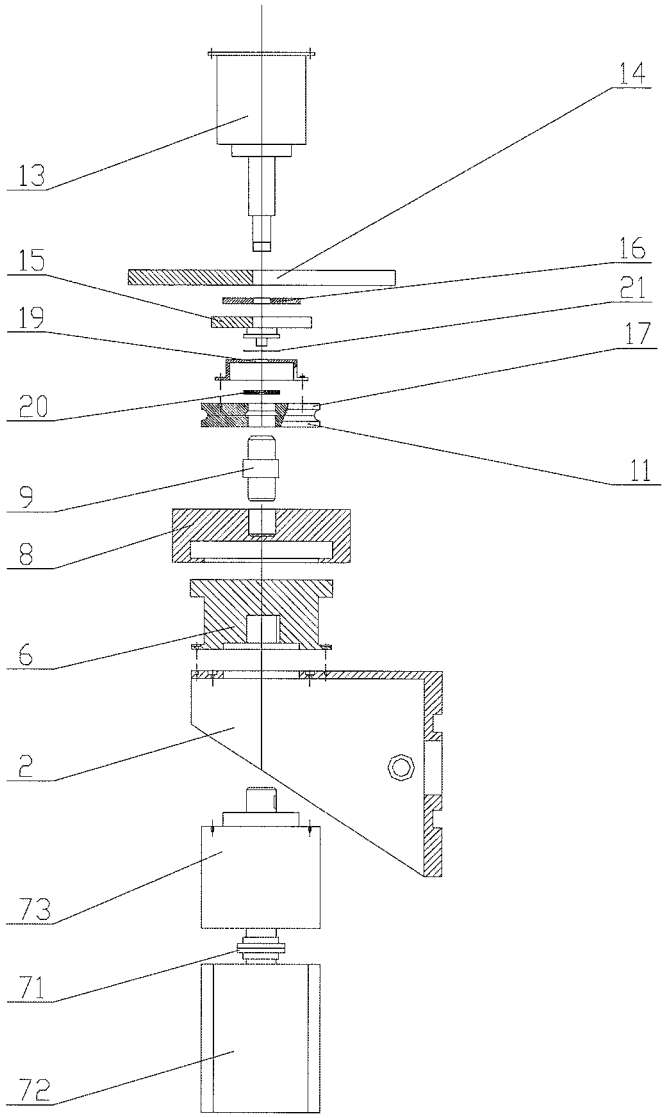
FIG. 4 is a schematic diagram of a left exploded view structure of the present device.
Figure 5:
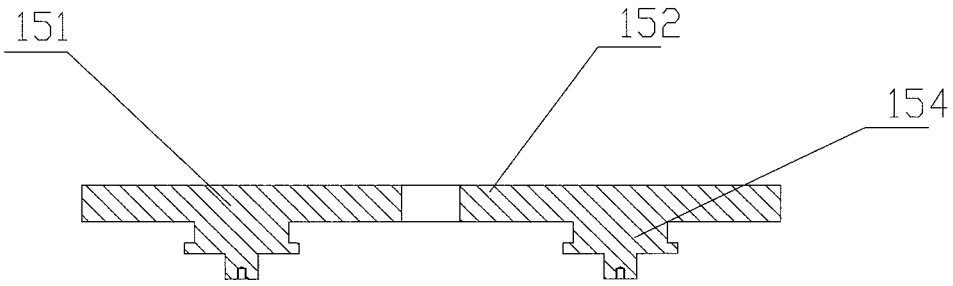
FIG. 5 is a schematic diagram of a main sectional view structure of an upper rotating base.
Figure 6:
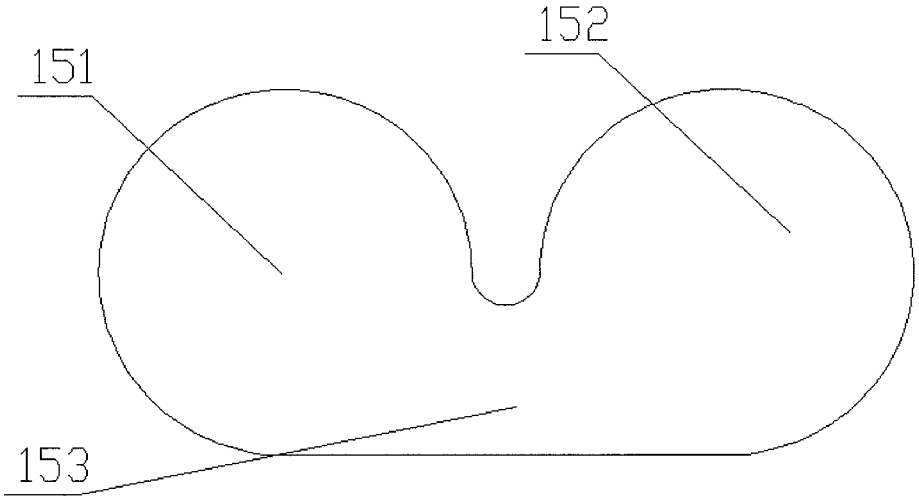
FIG. 6 is a schematic diagram of an overtop view structure of the upper rotating base.

The specific implementing solutions of the present invention are described in detail in combination with the drawings.

FIGS. 1-6 show a bending mold device for bidirectional pipe bending, comprising a hollow mounting base 2 arranged on a rack 1 in a sliding manner, an avoiding hole is arranged in one side of the mounting base 2 close to the rack 1, the rack is provided with a lead screw nut 5, the lead screw nut 5 penetrates into the mounting base 2 from the avoiding hole, and a translation lead screw 3 driving the mounting base 2 to slide is arranged in the mounting base 2, such that the translation lead screw 3 is kept clean to rotate smoothly, and one end of the translation lead screw 3 penetrates out of the mounting base 2 and is connected to a translation motor 4 arranged on the mounting base 2.

A pipe bending spindle 6 is rotatably disposed on the mounting base 2, and a power mechanism 7 driving the pipe bending spindle 6 to rotate is disposed on the mounting base 2. The power mechanism 7 comprises a servomotor 72 and a speed reducer 73 which are connected to a coupler 71, and the outputting shaft of the speed reducer 73 is connected to a pipe bending spindle 6. The upper end of the pipe bending spindle 6 is movably connected to a lower rotating base 8. The lower rotating base 8 comprises a rotating base body and an end cover, the lower surface of the rotating base body is provided with a long clamping slot parallel with the translation lead screw 3 in the initial position, and the upper part of the pipe bending spindle 6 is provided with a square clamping block 61 matched with the long clamping slot.

The upper part of the lower rotating base 8 is vertically provided with a first pipe bending shaft 9 and a second pipe bending shaft 10, and the first pipe bending shaft 9 and the second pipe bending shaft 10 may be alternatively concentric with the pipe bending spindle 6 through the sliding of the mounting base 2. The first pipe bending shaft 9 is rotatably provided with a first bending mold lower mold 11, and the second pipe bending shaft 10 is rotatably provided with a second bending mold lower mold 12.

The rack 1 includes a cylinder 13 above the lower rotating base 8. The end part of a piston rod of the cylinder 13 is fixedly provided with an upper limiting plate 14 and a lower limiting plate 16 in a sleeving manner, and an upper rotating base 15 is movably clamped between the upper limiting plate 14 and the lower limiting plate 16. The lower limiting plate 16 is a round plate not interfering with the rotation of the upper rotating base 15.

The upper rotating base 15 comprises a round left guiding part 151 with a radius having a distance from the first pipe bending shaft 9 to the piston rod of the cylinder 13, a round right guiding part 152 with a radius having a distance from the second pipe bending shaft 10 to the piston rod of the cylinder 13, and a connecting part 153 connected to a part of one side of the left guiding part 151 and a part of one side of the right guiding part 152. The piston rod of the cylinder 13 is located in a position, close to the connecting part 153, between the left guiding part 151 and the right guiding part 152 in the initial position. The upper rotating base 15 is rotatably provided with a first bending mold upper mold 17 and a second bending mold upper mold 18. The middle part of the first bending mold upper mold 17 is provided with a locating hole matched with the upper part of the first pipe bending shaft 9, and the middle part of the second bending mold upper mold 18 is provided with a locating hole matched with the upper part of the second pipe bending shaft 10. The holes in the lower parts of the locating holes are provided with bevels, such that the first pipe bending shaft 9 and the second pipe bending shaft 10 are convenient to joint.

The lower surface of the upper rotating base 15 is provided with two mounting columns 154 used for mounting the first bending mold upper mold 17 and the second bending mold upper mold 18 respectively. Bending mold covers 19 rotatably sleeve the mounting columns 154, the mounting columns 154 are provided with locating steps for locating the upper surfaces of the bending mold covers 19, and the mounting columns 154 are provided with copper liner plates 21 between the locating steps and the bending mold covers 19 to reduce the friction between them. The mounting columns 154 are provided with lower check rings 20 for positioning the bending mold covers 19, and the two bending mold covers 19 are connected to the first bending mold upper mold 17 and the second bending mold lower mold 18 respectively.

The working principle of the present device is: the tube stock 22 needing to be bent penetrates through a gap between the first bending mold lower mold 11 and the second bending mold lower mold 12, the first bending mold upper mold 17 and the second bending mold upper mold 18 are descended under the action of the cylinder 13 until being attached to the first bending mold lower mold 11 and the second bending mold lower mold 12, and the contacting part between the tube stock 22 needing to be bent and the bending mold is the part needing to be bent.

When pipe bending is performed counterclockwise, as shown in FIG. 1, at this point, the second pipe bending shaft 10 and the pipe bending spindle 6 are concentric, the servomotor 72 and the speed reducer 73 drive the pipe bending spindle 6 to rotate counterclockwise for a certain angle, the pipe bending spindle 6 drives the lower rotating base 8 to rotate counterclockwise for a certain angle, at this point, the first pipe bending shaft 9 rotates counterclockwise for a certain angle by taking the second pipe bending shaft 10 as a circle center under the drive of the lower rotating base 8, the second pipe bending shaft 10 auto-rotates counterclockwise for a certain angle, the tube stock 22 located between the first bending mold (including the first bending mold upper mold 17 and the first bending mold lower mold 11) and the second bending mold (including the second bending mold upper mold 18 and the second bending mold lower mold 12) is subjected to a counterclockwise action force of the first bending mold to be counterclockwise bent for a certain angle around the second bending mold, and after the bending action is finished, the lower rotating base 8 is in transmission through the pipe bending spindle 6 under the drive of the servomotor 72 and the speed reducer 73, thereby finishing the clockwise rotating reset.

When the pipe bending is performed clockwise, the translation lead screw 3 is driven by the translation motor 4 to rotate to drive the mounting base 2 to slide leftwards along the rack 1, since the first pipe bending shaft 9 and the second pipe bending shaft 10 are fixed relative to the lower rotating base 8, and the tube stock 22 is arranged between the first bending mold and the second bending mold in a penetrating manner to limit the left and right movement of the lower rotating base 8, the mounting base 2 moves leftwards such that the lower rotating base 8 relatively moves rightwards on the mounting base 2, when the first pipe bending shaft 9 and the pipe bending spindle 6 are concentric, the translation motor 4 stops working, such that the mounting base 2 stops sliding. At this point, the servomotor 72 and the speed reducer 73 drive the pipe bending spindle 6 to rotate clockwise for a certain angle, the second pipe bending shaft 10 rotates clockwise for a certain angle by taking the first pipe bending shaft 9 as a circle center under the drive of the lower rotating base 8, the first pipe bending shaft 9 auto-rotates for a certain angle, the tube stock 22 located between the first bending mold (including the first bending mold upper mold 17 and the first bending mold lower mold 11) and the second bending mold (including the second bending mold upper mold 18 and the second bending mold lower mold 12) is subjected to a clockwise action force of the second bending mold to be clockwise bent for a certain angle around the first bending mold, and after the bending action is finished, the lower rotating base 8 is in transmission through the pipe bending spindle 6 under the drive of the servomotor 72 and the speed reducer 73, thereby finishing the counterclockwise rotating reset.

The tube stock of different shapes can be bent through the mixed application of the clockwise pipe bending and counterclockwise pipe bending.

After the pipe bending is finished, the first bending mold upper mold 17 and the second bending mold upper mold 18 are ascended under the action of the cylinder 13 till that the first bending mold lower mold 11 and the second bending mold lower mold 12 are separated to a degree that the elbow pipe can be taken out, and the molded tube stock 22 is taken out.

The above embodiments merely illustrate the principle and its effects of the present invention, as well as the embodiments of part of applied embodiments rather than limiting the present invention; it should be pointed that those ordinary skilled in the art can make a plurality of transformations and improvements without departing from the creative concept of the present invention, and those transformations and improvements all belong to the protective scope of the present invention.

What is claimed is:

1. A bending mold device for bidirectional pipe bending, comprising:

a mounting base which is horizontally arranged on a rack in a sliding manner, wherein the mounting base is provided with a translation lead screw driving the mounting base to slide and a translation motor driving the translation lead screw to rotate, the rack is fixedly provided with a lead screw nut matched with the translation lead screw;

a pipe bending spindle which is rotatably disposed on the mounting base; and a power mechanism driving the pipe bending spindle to rotate is disposed on the mounting base;

wherein an upper end of the pipe bending spindle is movably connected to a lower rotating base, a lower surface of the lower rotating base is provided with a long clamping slot parallel with the translation lead screw in an initial position, wherein the pipe bending spindle is provided with a square clamping block matched with the long clamping slot, an upper part of the lower rotating base is vertically provided with a first pipe bending shaft and a second pipe bending shaft, the first pipe bending shaft and the second pipe bending shaft may be alternatively concentric with the pipe bending spindle through the sliding of the mounting base;

wherein the first pipe bending shaft is rotatably provided with a first bending mold lower mold, the second pipe bending shaft rotatably provided with a second bending mold lower mold, the rack includes is a cylinder which is located above the lower rotating base, wherein an end part of a piston rod of the cylinder is fixedly provided with an upper limiting plate and a lower limiting plate in a sleeving manner, an upper rotating base is movably clamped between the upper limiting plate and the lower limiting plate, the lower limiting plate is not interfering with the rotation of the upper rotating base, wherein the upper rotating base comprises a round left guiding part with a radius having a distance from the first pipe bending shaft to the piston rod of the cylinder, a round right guiding part with a radius having a distance from the second pipe bending shaft to the piston rod of the cylinder, and a connecting part connected to a part of one side of the round left guiding part and a part of one side of the round right guiding part, the piston rod is located in a position, close to the connecting part, between the round left guiding part and the round right guiding part before the upper rotating base is subjected to bidirectional pipe bending when the upper rotating base is in the initial position, wherein the upper rotating base is rotatably provided with a first bending mold upper mold and a second bending mold upper mold, a middle part of the first bending mold upper mold is provided with a first locating hole matched with an upper part of the first pipe bending shaft, and a middle part of the second bending mold upper mold is provided with a second locating hole matched with an upper part of the second pipe bending shaft, wherein a lower surface of the upper rotating base is provided with two mounting columns used for mounting the first bending mold upper mold and the second bending mold upper mold respectively, two bending mold covers rotatably sleeve the two mounting columns, the two mounting columns are provided with lower check rings for positioning the two bending mold covers, and lower parts of the two bending mold covers are connected to the first bending mold upper mold and the second bending mold upper mold respectively.

2. The bending mold device for bidirectional pipe bending according to claim 1, wherein the two mounting columns are provided with locating steps for locating upper surfaces of the two bending mold covers, and the two mounting columns are provided with copper liner plates between the locating steps and the two bending mold covers.

3. The bending mold device for bidirectional pipe bending according to claim 1, wherein holes in the lower parts of the locating holes of the first bending mold upper mold and the second bending mold upper mold are provided with bevels.

4. The bending mold device for bidirectional pipe bending according to claim 1, wherein the lower rotating base comprises a rotating base body, and the long clamping slot is arranged in the rotating base body.

5. The bending mold device for bidirectional pipe bending according to claim 1, wherein the mounting base is a hollow mounting base, a one side of the mounting base close to the rack is provided with an avoiding hole, the lead screw nut on the rack penetrates into the mounting base from the avoiding hole, the translation lead screw is rotatably arranged in the mounting base, a one end of the translation lead screw penetrates out of the mounting base, and the translation motor is arranged outside the mounting base and is connected to said one end of the translation lead screw penetrating out of the mounting base.

6. The bending mold device for bidirectional pipe bending according to claim 1, wherein the power mechanism comprises a servomotor and a speed reducer which are connected by a coupler and an outputting shaft of the speed reducer is connected to the pipe bending spindle.

7. The bending mold device for bidirectional pipe bending according to claim 2, wherein the mounting base is a hollow mounting base, a one side of the mounting base close to the rack is provided with an avoiding hole, the lead screw nut on the rack penetrates into the mounting base from the avoiding hole, the translation lead screw is rotatably arranged in the mounting base, a one end of the translation lead screw penetrates out of the mounting base, and the translation motor is arranged outside the mounting base and is connected to said one end of the translation lead screw penetrating out of the mounting base.

8. The bending mold device for bidirectional pipe bending according to claim 3, wherein the mounting base is a hollow mounting base, a one side of the mounting base close to the rack is provided with an avoiding hole, the lead screw nut on the rack penetrates into the mounting base from the avoiding hole, the translation lead screw is rotatably arranged in the mounting base, a one end of the translation lead screw penetrates out of the mounting base, and the translation motor is arranged outside the mounting base and is connected to said one end of the translation lead screw penetrating out of the mounting base.

9. The bending mold device for bidirectional pipe bending according to claim 4, wherein the mounting base is a hollow mounting base, a one side of the mounting base close to the rack is provided with an avoiding hole, the lead screw nut on the rack penetrates into the mounting base from the avoiding hole, the translation lead screw is rotatably arranged in the mounting base, a one end of the translation lead screw penetrates out of the mounting base, and the translation motor is arranged outside the mounting base and is connected to said one end of the translation lead screw penetrating out of the mounting base.

10. The bending mold device for bidirectional pipe bending according to claim 2, wherein the power mechanism comprises a servomotor and a speed reducer which are connected by a coupler and an outputting shaft of the speed reducer is connected to the pipe bending spindle.

11. The bending mold device for bidirectional pipe bending according to claim 3, wherein the power mechanism comprises a servomotor and a speed reducer which are connected by a coupler and an outputting shaft of the speed reducer is connected to the pipe bending spindle.

12. The bending mold device for bidirectional pipe bending according to claim 4, wherein the power mechanism comprises a servomotor and a speed reducer which are connected by a coupler and an outputting shaft of the speed reducer is connected to the pipe bending spindle.

* * * * *